US006457615B1

(12) United States Patent
Lam

(10) Patent No.: US 6,457,615 B1
(45) Date of Patent: Oct. 1, 2002

(54) GARMENT HANGER

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 0 days.

(21) Appl. No.: 09/703,204

(22) Filed: Oct. 31, 2000

(51) Int. Cl.[7] ..... A47G 25/14
(52) U.S. Cl. ..... 223/89
(58) Field of Search ..... 223/85, 92, 88, 223/95, DIG. 4, 89, 94

(56) References Cited

U.S. PATENT DOCUMENTS 2,492,226 A * 12/1949 Kohl et al. ..... 223/85
2,498,400 A * 2/1950 Du Lude ..... 223/85
5,029,739 A * 7/1991 Blanchard et al. ..... 223/88
5,074,445 A * 12/1991 Chen ..... 223/85
5,645,200 A * 7/1997 McDowell ..... 223/89
6,202,905 B1 * 3/2001 Heide ..... 223/94
6,227,422 B1 * 5/2001 Hansen ..... 223/87

* cited by examiner

*Primary Examiner*—Bibhu Mohanty

(57) ABSTRACT

Embodiments of garment hangers are disclosed to have a configurable secondary attachment hooks (320) and an adjustment knob (311). The secondary attachment hook stays within the thickness region of the garment hanger in a storage mode and protruded to receive the suspension member of another hanger in a second functional mode.

21 Claims, 4 Drawing Sheets

GARMENT HANGER

FIELD OF THE INVENTION

The present invention relates generally to a configurable secondary attachment hook of a garment hanger.

BACKGROUND OF THE INVENTION

Many garment hangers provides a pant bar, or brace connecting in between the remote ends of the shoulder supporting areas. This brace strengthens the supporting property of the supporting arms and also provides a location to put the pants. On the other hand, the existence of the brace requires more room to pack the garment hangers and increases the transportation and storage cost. Furthermore, a user is required to remove the clothing supported on the hanger before the pants can be accessed.

It is the design goal of the invention to provide a configurable secondary attachment hook on the invented hanger to replace the supporting brace. The hook is designed for a user to support a pair of pants on a second traditional hanger, then support the traditional hanger with the second attachment hook of the invented hanger.

The prior art is replete with various designs of garment hangers, which incorporate structure of a secondary attachment hook. U.S. Pat. No. 1,781,628 to Boyle discloses a garment hanger having a secondary hook attached on the front side of the medial portion of a garment hanger. U.S. Pat. No. 1,563,735 to Fetters discloses a coat hanger with a pair secondary attachment hooks; U.S. Pat. No. 835,464 to Palmenberg; U.S. Pat. No. 1,490,301 to Ward and the references cited therein, also exemplify such constructions.

SUMMARY OF THE INVENTION

The present invention is directed to garment hangers having a secondary attachment suspension member, typically an open-ended hook. Traditional garment hangers provide a brace, or pant bar connecting in between the remote ends of the shoulder supporting areas. This pant bar strengthens the supporting arms and also provides a location to support the pants simultaneously with another upper clothing on the same hanger. On the other hand, the existence of the pant bar increases the transportation and storage cost of the garment hanger. This is because in a packaging design, the pant bar prohibits the neighboring hanger to access the area enclosed by the pant bar and the two supporting arms which forms a solid triangle. There is another advantage for a user to support a pair of pants onto a second hanger and then attach the second hanger to the secondary hook of the first hanger. This arrangement enables the user to easily access the pants without removing the clothing supported on the hanger, as required for the traditional triangular hanger. Besides, it is more convenient for a user to coordinate; match or group different upper clothing with pants or skirts.

In the situation of an adjustable garment hanger, the pant bar connecting between the remote ends of the supporting arms creates some other design difficulties. Firstly the remote ends of the moving supporting arms are of variable distance apart. A variable length design will increase the complexity of the pant bar and also raises cost. Another option is to design the pant bar to attach with the fixed length supporting arms, upon which the movable support arms are adjusted to vary the hanger supporting width. In this way the length of the pant bar is fixed at the minimum supporting width of the adjustable garment hanger. This length may be inadequate to support the pants of the bigger users who require the adjustable garment hanger to be fully expanded. According to this research study, there is a desire to eliminate the supporting pant bar of an adjustable garment hanger, and replace it with the secondary attachment hook for costing and convenience advantages.

In order for the garment hanger to be symmetrical balanced, it is a design requirement for the secondary attachment hook to locate at the vertical central axis of the garment hanger, preferably extending from the medial portion. The area located beneath the medial portion is an ideal location to position the secondary attachment hook. On the other hand, it is disclosed in applicant's issued U.S. Pat. 5,102,019 to have a adjustment knob located at the medial portion of an adjustable width garment hanger. The knob enables the user to adjust the width of the garment hanger with the clothing supported on the garment hanger. Similarly, the perfect location of this adjustment knob is also along the vertical axis of the garment hanger, preferably the area beneath the medial portion. Accordingly, the secondary attachment hook is competing with the adjustment knob for the prime location around the medial portion. Due to the complexity of the adjustment width mechanism, priority is often given to the knob for selecting the location.

It is also a design goal of the invention to have the secondary attachment hook to retreat to a position not to exceed the natural thickness of the garment hanger, to facilitate storage and packaging. It is also a design goal of the invention to provide a secondary attachment hook, protruded from either the front or rear side of the garment hanger, to facilitate a user to attach the second hanger. In a first preferred embodiment of the invention, the structure of the secondary attachment hook is provided in the form of a drawer. When the drawer is closed, the secondary attachment hook submerges into the body of the medial portion to provide the first storage mode. When the drawer is opened, the secondary attachment hook emerges from the frontal or rear surface of the garment hanger for receiving the suspension member of another garment hanger.

In another preferable embodiment, the secondary suspension hook is rotatable along the axis of the suspension member either on top or below the medial portion. When the hanger is configured to provide the storage mode, the hook is rotated to a position parallel to the span of the garment hanger. When the secondary attachment hook is reconfigured to provide the second functional mode, the suspension hook is rotated by approximately 90 degree, so that the secondary hook extends beyond the frontal or rear surface, of the garment hanger. A portion of the secondary attachment hook is preferred to be in the shape of a hollow tube, so that it can be slid into the linear region of the primary suspension member, and rotate around this linear region. It is also an optional design feature for the secondary attachment hook to be tightly fitted with the first attachment hook so that it will not be switched in between different modes of operation unexpectedly. Alternatively, resilient detents may be added to keep the position of the storage mode from the functional mode.

In another preferred embodiment, the secondary suspension member is formed in the shape of a lever, equipped with a hinge enabling it to transform in between the two predefined modes of configurations. In the first mode of operation, the lever stays flat with the surface of the medial portion. When the lever is rotated by a certain predefined angle, a hook shape structure is protruded from the surface of the medial portion ready to receive the hook of another garment hanger.

Accordingly it is submitted that the term configurable define that the secondary attachment hook is switchable in between at least two predefine modes of operation, each service a different design purpose. The novel features of the invention enable the garment hanger to provide a configurable secondary attachment member for receiving the hook of a separated garment hanger; so as to facilitate the user to efficiently access; coordinate; match or group pants or skirts with different upper clothing.

The novel features of the invention are set forth with particularity in the appended claims. The invention will be best understood from the following description when read in conjunction with the accompanying drawings.

DESCRIPTION OF THE PREFERRED EMBODIMENTS

Figure 1A:
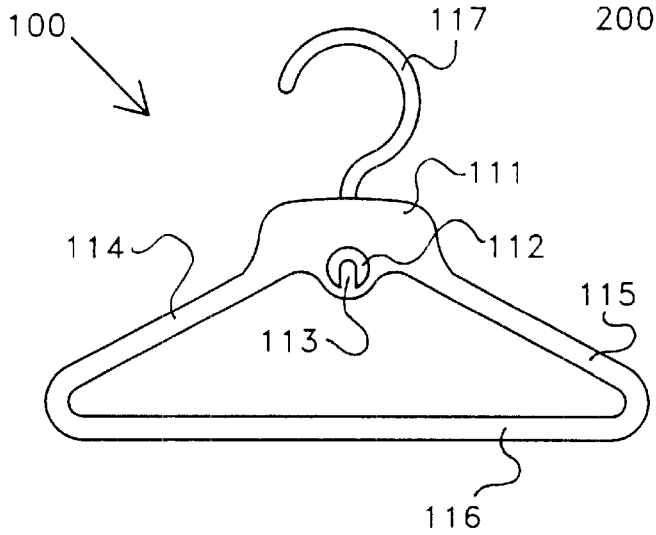
FIG.1a PRIOR ART
FIG. 1*a* is the front view of a prior art embodiment having a secondary attachment hook.
Figure 1B:
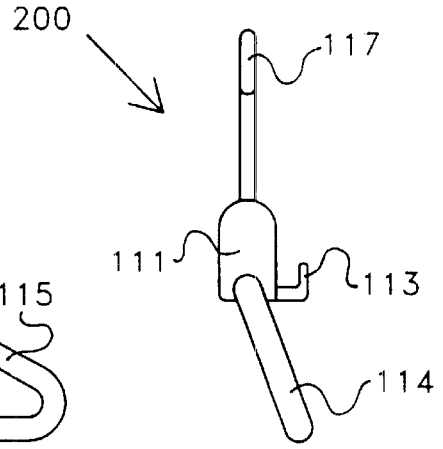
FIG.1b PRIOR ART
FIG. 1*b* is the side view of a view of FIG. 1*a;*

Attention is first directed to FIG. 1, which is an elevation view of a prior art garment hanger 100 demonstrating a secondary attachment suspension member 113. The garment hanger has a first suspension member 117 extending vertically from the medial portion 111. Supporting arms 114 and 115 extend from the medial portion 111 in laterally opposite directions. The two remote ends of the supporting arms 114 and 115 are connected by a brace or pant bar 116. Through hole 112 enabling the injection molding tool to form the hook 113. The secondary hook 113 is conveniently located at the central axis of the hanger, beneath the medial portion 111. FIG. 1*b* shows the side view of the prior art hanger 100. The secondary suspension member 113 protrudes from the front side of the medial portion to receive the suspension hook of another garment hanger.

Figure 2:
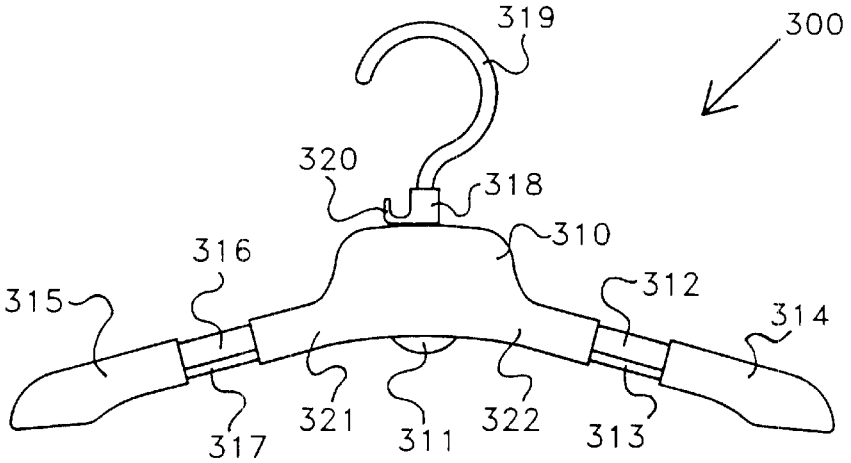
FIG. 2 is the front view of a preferred embodiment showing an adjustable garment hanger having a secondary attachment hook.
Figure 3A:
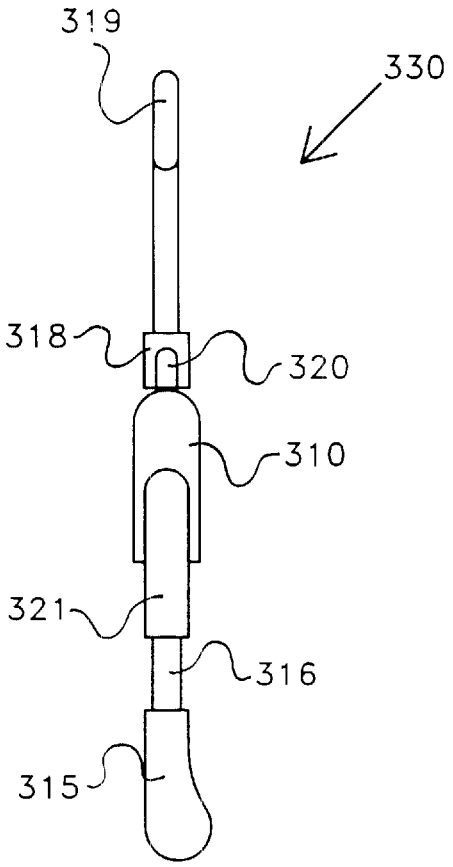
FIG. 3*a* is the side view of FIG. 2 showing the secondary attachment hook configured in the storage position.
Figure 3B:
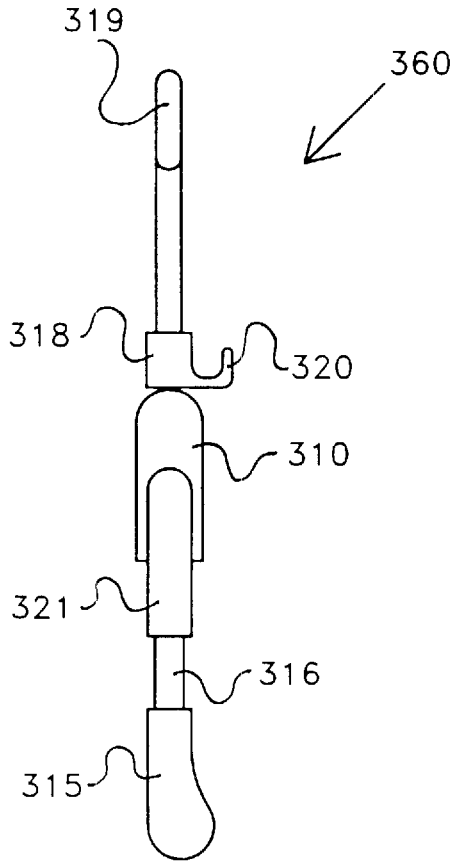
FIG. 3*b* is the side view of FIG. 2 showing the secondary attachment hook configured in the functional position.

Attention is now directed to FIG. 2, which demonstrates a preferred embodiment. Garment hanger 300 is an adjustable garment hanger structured with a medial portion 310 and two supporting arms 321 and 322. Arms 316 and 312 are fixed length extensions of the supporting arms 321 and 322. The movable arms 315 and 314 travels along the fixed length extension arms 316 and 312. Tongues 313 and 317 extends from the movable arms 315 and 314 are coupled to an adjustment mechanism located inside the medial portion 310 for the reciprocal adjustment of the movable arms. Knob 311 coupled to the adjustment mechanism enables the movable arms to be adjusted while a garment occupies the hanger. When comparing with the prior art hanger 100 of FIG. 1*a*, two characteristics are demonstrated by this preferred embodiment. Firstly the pant bar 116 is deleted in the design of this garment hanger. Secondly, an adjustment knob 311 occupies the position of the secondary suspension hook 113 shown in FIG. 1*a*. In order to enable the adjustment garment hanger 300 to support a pair of pants, a second garment hanger can be supported by the secondary suspension hook 320 located on top of the medial portion 310 and below the first suspension hook 319. FIG. 3*a* shows the side view of the adjustable garment hanger 300. It is observed that the secondary suspension hook is positioned in the lateral plane of the garment hanger 330. This position of the secondary suspension hook defines the storage mode of operation. The profile of the secondary hook lies within the thickness of the hanger such that multiple hangers can be stacked tightly together to save storage and packaging space. FIG. 3*b* shows the side-view of the hanger 360, which the secondary suspension hook 320 is configured to provide the functional mode. The secondary suspension hook 320 is rotated by approximately 90 degree, and protrudes to the front or rear side of the hanger 360. The secondary suspension hook 320 is now ready to receive the hook of another garment hanger, which holds a pair of pants or a skirt. This position defines the second functional mode of operation.

Figure 4A:
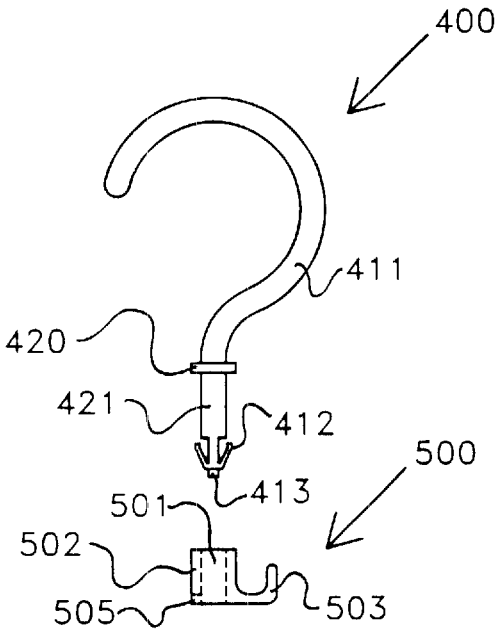
FIG. 4*a* shows the first and second suspension members of a preferred embodiment.
Figure 4B:
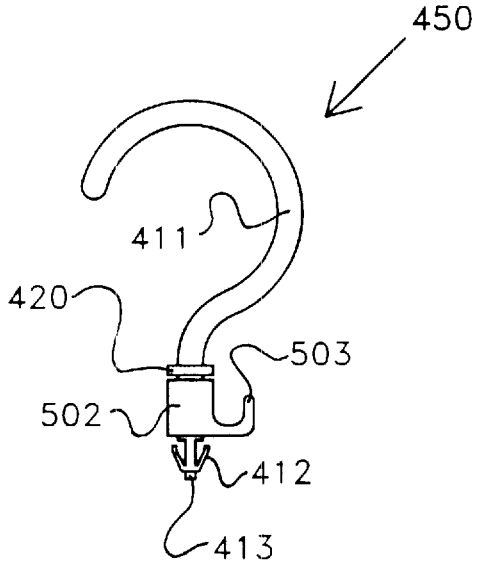
FIG. 4*b* illustrates the first and second suspension members of FIG. 4*a* assembled.
Figure 6A:
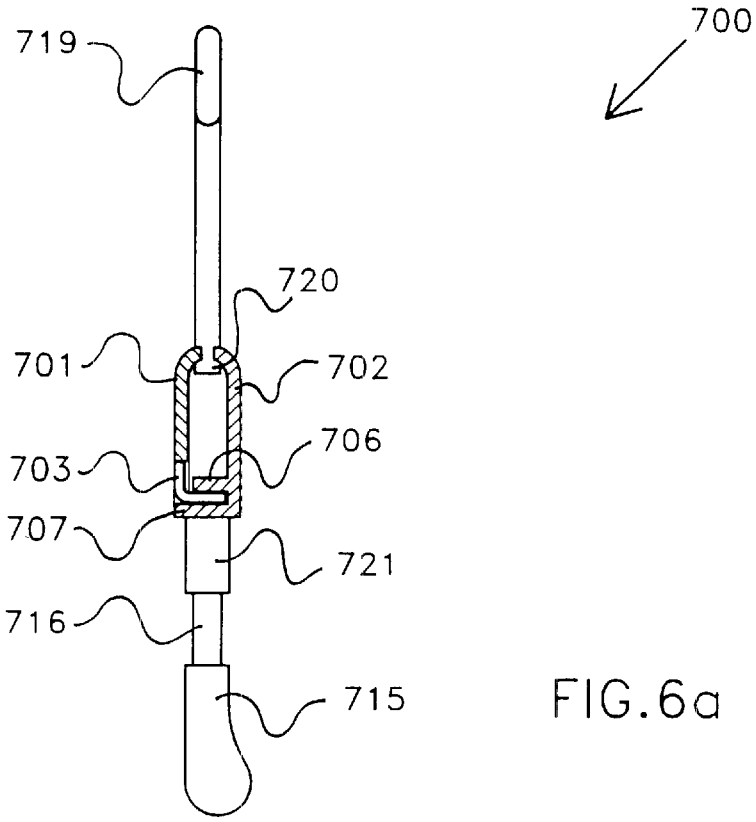
FIG. 6*a* shows the side sectional view of another preferred embodiment having the secondary suspension member configured in the storage mode.

FIG. 4*a* illustrates the front view of a typical first suspension member 400 and a secondary suspension attachment hook 500. The first suspension member 400 comprises a hook 411; a stopper 420 and a connector 413. The connector 413 has one or more elastic flanges 412. The flanges 412 allow the suspension member to be inserted into the receiver located at the medial portion 310 of the garment hanger 300 and keep it in position. The secondary attachment hook 500, comprises of a tubular hole 501, one or more detent slots 505 and also a hook 503. When the secondary suspension attachment hook 500 is inserted into the first suspension member 400 through the connector 413, the flanges yield when the tubular hole of the suspension member 500 is passing through the flanges. An optional stopper 420 stops the suspension member 500 to enter the suspension area 411 of the first suspension member. FIG. 4*b* demonstrates the structure of the assembly when the second suspension member 500 is fully inserted into the linear region 421. The flanges 412 returns to their original position and prohibit the secondary suspension member 500 from being removed. It is observed that the resilient flanges act as one way valve to allow the suspension member 500 to be inserted into the first suspension member 400 in one direction and prevent it from being removed at the opposite direction. The suspension assembly 450 can then be packaged with the main frame body starting from the medial portion 310 of FIG. 2. Any user then easily inserts the suspension assembly into the medial portion 310. Alternatively, the resilient flanges 420 can be replaced by a smaller solid stopper 720 as illustrated in FIG. 6*a*. The stopper 720 is trapped in between the front and rear housings of the medial portion. This design requires the hook assembly to be factory assembled with the hanger frame.

When the assembly 450 of FIG. 4*b* is inserted into the medial portion of the garment hanger 300 of FIG. 2, the secondary suspension hook 320 is free to rotate in between the predefined storage position and the functional position. The stopper 420 is precisely positioned to provide very little play in between the medial portion 310 and the stopper 420 for the secondary suspension member 500. One or more tiny mating ribs can be provided on top of the medial portion 310 to interact with the detent slot 505 of the secondary suspension member 500. The detent design helps to keep the secondary suspension member 500 to stay in any one of the operation modes.

Figure 5A:
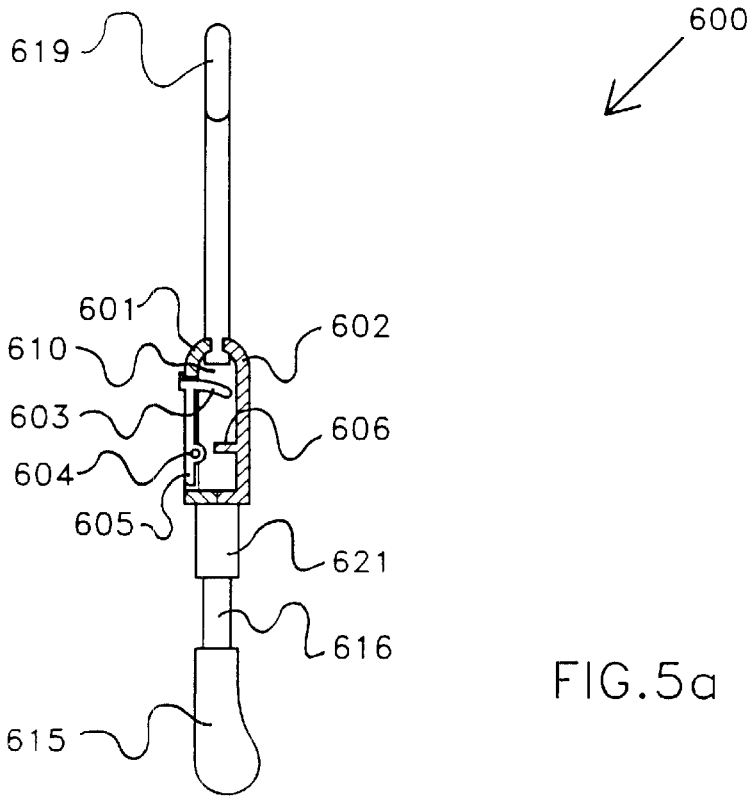
FIG. 5*a* shows the side sectional view of another preferred embodiment having the secondary suspension member configured in the storage mode.
Figure 5B:
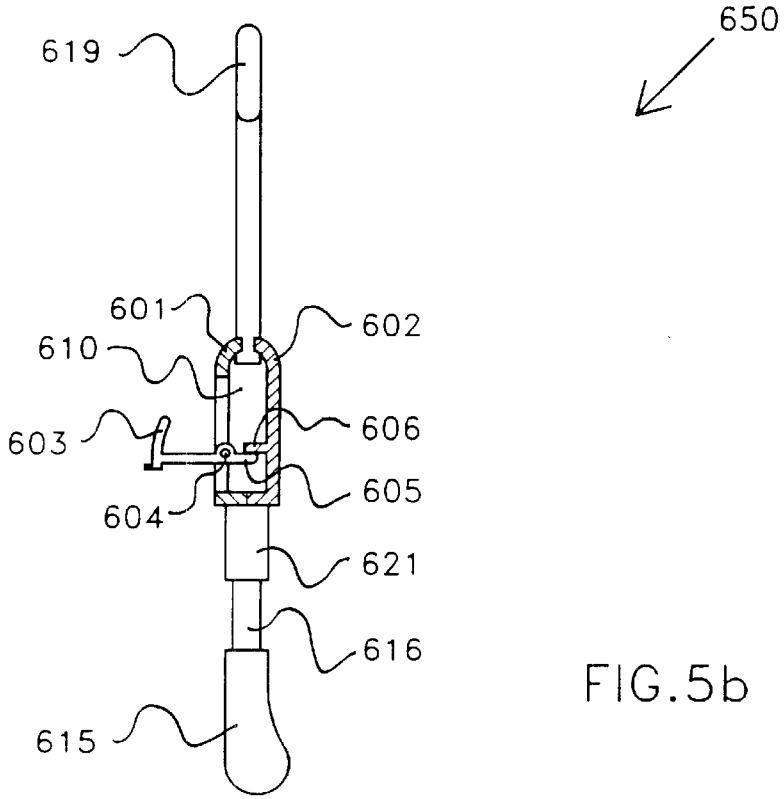
FIG. 5*b* illustrates the side sectional view of the hanger in FIG. 5*a* having the secondary suspension member configured to provide the functional mode.

Attention is now directed to FIG. 5*a*, which illustrates the storage mode of another preferred embodiment. The secondary hook 603 submerges into the cavity 610 of the medial portion of the garment hanger. When the secondary hook 603 is turned outward against the pivot point 604, the hanger is converted into a functional mode as illustrated in FIG. 5*b*. The tail 605 is stopped by the stopper 606 of the medial portion. The hook 603 is then ready to receive the suspension hook of another garment hanger.

Figure 6B:
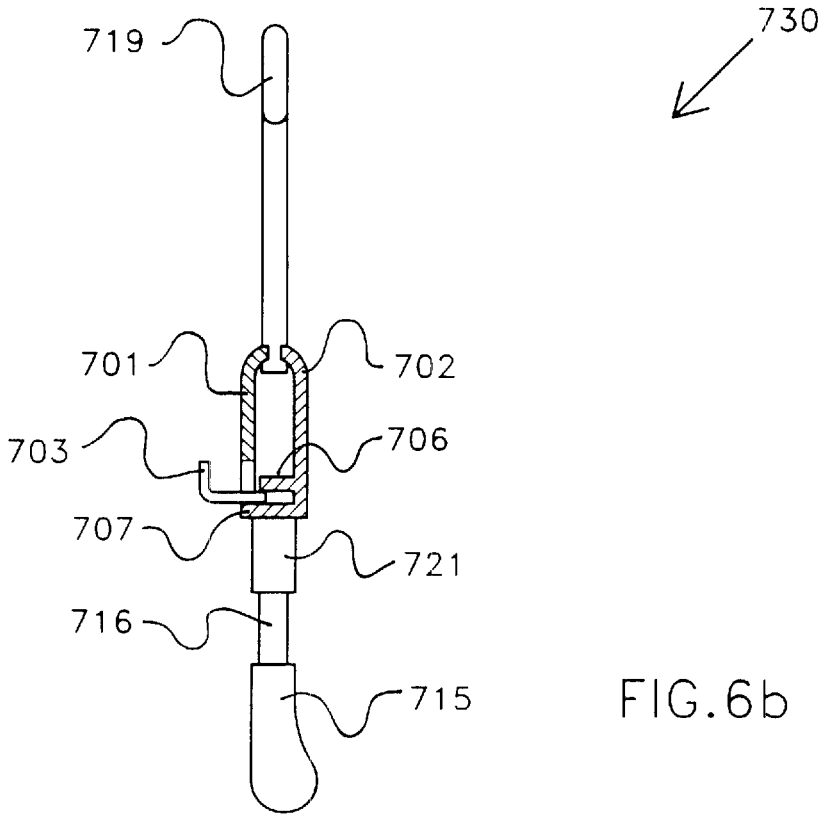
FIG. 6*b* illustrates the side sectional view of the hanger in FIG. 6*a* having the secondary suspension member configured to provide the functional mode.

FIG. 6*a* illustrates the storage mode of another preferred embodiment. The secondary suspension member 703 is structured in the form of a drawer. When the drawer is closed, the surface of secondary suspension hook 703 stays flat to the rear surface 701 of the medial portion. When the drawer 703 is pulled, the secondary suspension member is reconfigured into the functional mode as illustrated in FIG. 6*b*. The secondary hook 703 provides an upward facing opening to receive the hook of another garment hanger. Stopper flanges (not shown) interacting with the rear housing of the medial portion are required at the two sides of the suspension hook 703 to prevent the hook to be completely removed from the medial portion housing. The design principle of one direction resilient flange design similar to the flanges 412 of FIG. 4*a* and FIG. 4*b* can be applied to provide the similar effect.

In reviewing the common properties of the various embodiments described, it can be observed that the secondary suspension member provides at least two operation modes according to the predefined configurations of the garment hanger. A first storage mode had been defined requiring the secondary suspension member to stay within the natural thickness of the garment hanger to facilitate storage or packaging. A second functional mode had been defined to allow the secondary suspension hook to protrude from the front or the rear surface of the garment hanger to receive the suspension hook of another garment hanger. It is submitted that any other configurable designs capable to serve the predefined application modes known to an ordinary person skilled in the art are included in the scope of this invention. Similarly, different structural designs capable to retain the secondary suspension member in any of its modes of operation are also included in the scope of this invention. The preferred embodiments of the invention described herein are exemplary and numerous modifications, dimensional variations and rearrangements can be readily envisioned to achieve an equivalent result, all of which are intended to be embraced within the scope of the appended claims.

I claim:

1. A garment hanger comprising:

a medial portion of thickness t;

first and second elongate supporting arms extending from said medial portion in lateral opposite directions;

a first suspension member extending from said medial portion; and a second suspension member structured to receive the hook of an external garment hanger;

wherein said first and second suspension members are positioned within the thickness t of said medial portion to define a first storage mode;

said second suspension member is configurable to protrude towards the front or rear direction of said medial portion for receiving the suspension member of said external garment hanger so as to define a second functional mode; and the extension of said second suspension member is shorter than the length of said first or second elongate supporting arm.

2. The garment hanger of claim 1 wherein said second suspension member comprises a hook having an opening facing upward.

3. The garment hanger of claim 1 wherein said second suspension member is pre-assembled with said first suspension member before connecting into said medial portion.

4. The garment hanger of claim 1 wherein said second suspension member is pre-assembled onto said medial portion.

5. The garment hanger of claim 1 wherein said first suspension member has a linear portion extending from said medial portion and said second suspension member is structured to rotate around this linear portion.

6. The garment hanger of claim 5 wherein said first suspension member comprising resilient means enabling said second suspension member to be mounted onto said first suspension member in a first direction and preventing said second suspension member to be removed form said first suspension member in a second opposite direction.

7. The garment hanger of claim 5 wherein said second suspension member comprises of a tubular hole dimensioned to fit the linear portion of said first suspension member.

8. The garment hanger of claim 7 wherein said tubular hole is tightly fitted with the linear portion of said first suspension member.

9. The garment hanger of claim 5 further comprising at least a stopper to limit said second suspension member to stay within a range of said linear portion.

10. The garment hanger of claim 1 wherein said first suspension member comprises a first hook; and said second suspension member is positioned in between said first hook and said medial portion.

11. A garment hanger suspension assembly structured to support a garment hanger comprising a first suspension member having a suspension portion, a linear portion and a connector portion; said connector portion is structured to interface with the medial portion of said garment hanger having a thickness t; and a second suspension member having a suspension portion smaller than the suspension portion of said first suspension member;

wherein said first and second suspension members are positioned within the thickness t of said medial portion to define a first storage mode and said second suspension member is a configurable to protrude towards the front or rear direction of said medial portion to define a second functional mode.

12. The assembly of claim 11 wherein said second suspension member comprises a tubular hole to rotate around the linear portion of said first suspension member.

13. The assembly of claim 12 wherein said connector portion is structured to allow the tubular hole of said second suspension member to be dressed into said linear portion in one direction and prohibit said second suspension member to be removed from said linear portion in a second opposite direction.

14. The assembly of claim 12 wherein said hole is tightly fitted with the linear portion of said first suspension member.

15. The assembly of claim 11 wherein said first suspension member further comprising a stopper to prohibit said second suspension member from entering into the suspension portion of said first suspension member.

16. The assembly of claim 13 wherein the suspension portion of said first suspension member comprises an open ended hook.

17. The garment hanger of claim 1 wherein said second suspension member is configured to transform from said first storage mode to said second functional mode through a rotational motion.

18. The garment hanger of claim 1 wherein said second suspension member is positioned above the bottom surface of said medial portion during said storage mode.

19. The garment hanger of claim 1 wherein said second suspension member is positioned inside said medial portion during said storage mode.

20. A garment hanger comprising:

a medial portion of thickness t;

first and second elongate supporting arms extending from said medial portion in lateral opposite directions;

a first suspension member extending from said medial portion; and a second suspension member positioned above the bottom surface of said medial portion;

wherein said first and second suspension members are positioned within the thickness t of said medial portion to define a first storage mode and said second suspension member is configurable to protrude towards the front or rear direction of said medial portion to define a second functional mode.

21. The garment hanger of claim 11 wherein said second suspension member comprises a hook mounted onto the linear region of said first suspension member.

* * * * *